US008591162B2

(12) United States Patent
Strong

(10) Patent No.: US 8,591,162 B2
(45) **Date of Patent: *Nov. 26, 2013**

(54) PERSONNEL TRANSFER SYSTEM

(71) Applicant: Philip A. Strong, Barcelona (ES)

(72) Inventor: Philip A. Strong, Barcelona (ES)

(73) Assignee: Reflex Marine Ltd., Aberdeen (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/737,014

(22) Filed: Jan. 9, 2013

(65) Prior Publication Data

US 2013/0121791 A1 May 16, 2013

Related U.S. Application Data

(63) Continuation of application No. 12/467,903, filed on May 18, 2009, now Pat. No. 8,439,622.

(30) Foreign Application Priority Data

May 19, 2008 (EP) ..... 08380155

(51) Int. Cl.
*B63C 9/02* (2006.01)
*B63B 27/14* (2006.01)

(52) U.S. Cl.
USPC ..... 414/139.5; 114/363; 114/362; 441/80; 182/142

(58) Field of Classification Search
USPC ..... 414/139.5; 114/123, 348, 349, 355, 114/362–363, 365
See application file for complete search history.

(56) References Cited

U.S. PATENT DOCUMENTS 5,092,644 A * 3/1992 Melerine ..... 294/77
7,121,600 B2 * 10/2006 Liberato et al. ..... 294/77

* cited by examiner

*Primary Examiner* — Gregory Adams
*Assistant Examiner* — Lynn Schwenning
(74) *Attorney, Agent, or Firm* — Coats & Bennett, P.L.L.C.

(57) ABSTRACT

A transfer device for transferring people and/or personal equipment from a first location to a second location, the transfer device being coupled to a lifting device and comprising an outer structure in the form of a cage connected to a base and defining an inner space. Seating elements are disposed on the device's base, arranged radially around its center. The device also comprises shock absorbing means situated on the sides of the outer structure facing each of the seating elements to protect passengers from frontal impacts.

12 Claims, 5 Drawing Sheets

PERSONNEL TRANSFER SYSTEM

This application claims priority to European Patent Application No. EP08380155.5, titled "Personnel Transfer System," filed May 19, 2008, and incorporated herein by reference in its entirety.

TECHNICAL FIELD

The present invention relates generally to the transfer of personnel, and in particular to a personnel transfer system having integral safety features for the transfer of personnel from one vessel to an offshore installation or another vessel.

BACKGROUND

The process of transferring personnel from one vessel to an offshore installation or another vessel while both are at sea is a difficult and dangerous aspect of offshore platform work, particularly where rough seas or high wind conditions are present. Existing methods of achieving transfer have significant limitations in terms of safety and practicality. This invention offers a system which reduces the risks associated with transfer in a range of weather conditions.

In this field it is already known that there are several methods of transfer, which include those outlined below.

Most offshore transfers involve the use of a crane to lift and move the apparatus that carries personnel and equipment from an offshore platform or a vessel to another vessel, or vice versa.

Currently, a widespread apparatus to accomplish such a transfer is a rope basket having a rigid bottom, commonly known in the industry as a "Billy Pugh" basket. Personnel stand on the rigid bottom and hold onto the rope lines for support and safety. This apparatus has several major drawbacks. First, personnel are not typically secured to the basket. Second, personnel are not protected in any way from impact during the transfer. Third, additional space to transfer equipment is minimal. Finally, there is minimal provision to protect personnel and equipment in the event of submersion of the basket Another structure for transferring personnel and equipment is described in U.S. Pat. No. 5,713,710. This patent discloses an apparatus for transferring objects from a first location to a second location. This transfer is accomplished through the use of a lifting device and a transfer device. The transfer device comprises an outer structure which defines an inner space in which an object to be transferred may be located and a securing device to secure the object to the transfer device during transfer. The transfer device of Strong is buoyant and self-righting when in water. The transfer device disclosed in Strong may include shock absorbing means on the underside.

In an intent to improve the structure described in U.S. Pat. No. 5,713,710, US patent application number 2001/0018015 A1 describes another structure capable of being attached to a lifting device such as a crane hook and comprising a load bearing support structure which supports a base and walled surface over a large surface area. A central support member for personnel is attached to a point on the base of the apparatus and a point on the top portion of the apparatus to provide stable support for a seating assembly and includes a dynamic compression system for supporting and distributing various weights. The load bearing central support structure is designed to create multiple pressure and stress points, thereby decreasing the force exerted at each point.

Although the apparatus described in U.S. Pat. No. 5,713,710 and US patent application number 2001/0018015 A1 are satisfactory in many respects, it has now been found that there is still room for improving the level of protection for the personnel during ingress to, transport and egress from said structures.

SUMMARY

The present invention relates to an apparatus for transferring objects from a first location to a second location or transfer device which offers optimal protection for the personnel during ingress to, transport and egress from said structures The transfer device of the invention has means for coupling it to a lifting device and comprises an outer structure in the form of a cage having a base in the form of a polygon which outer structure defines an inner space comprising seating elements where the people may sit during transfer.

The term polygon should not be given a strict geometric interpretation requiring that all the sides of the base are straight lines. Conversely, the term is used in this specification to encompass also figures where the sides of the polygonal base may show some degree of curvature as it shown, for example, in FIG. 2.

In a first aspect of the present invention, the seating elements are disposed on the base, radially around its centre and facing alternating sides of the polygon. The sides of the outer structure facing each of the seating elements comprise shock absorbing means to protect seating people from frontal impacts. This eliminates one of the important drawbacks of previously known devices.

In another aspect the present invention seeks to further improve the safety of the passenger being transferred by guaranteeing a quick and safe egress from the device since it has been found that speed of egress is a key factor contributing to the safety of transfer devices.

It has also been found that speed of egress is often negatively affected by the passenger's hesitation to follow the fastest route of egress in particular when more than one such route exists. To avoid such hesitation the transfer device of the invention has been provided with seating elements comprising a seat and a backrest wherein at least one of the backrest and the seating element has been designed to be asymmetric with respect to a vertical plane (A-A') passing through the centre the base and dividing the seat and the backrest in two parts. The asymmetry of the seating elements directs the passenger to take preferentially one of the two possible directions for exiting the transfer device thereby effectively reducing the time to egress and contributing to safety.

In an embodiment of the present invention the asymmetric seating element comprises a backrest having extensions towards both sides of the seating element, the extension towards one of the sides being more prominent that the extension towards the opposite side. The backrest's lateral extensions do not only contribute to guide the passenger's direction of egress by virtue of their asymmetry, but also play a role as securing means contributing to prevent lateral involuntary displacement of the passenger.

One further measure that has been found useful to avoid the passenger's hesitation to follow the fastest route of egress is the presence of indicating means showing to the passenger occupying the seating elements the preferred direction of egress.

In another aspect of the present invention it has also been found that speed of egress could be further increased by reducing the time a passenger needs to stand up from the seating position as this represents a substantial portion of the total time to exit. To reduce the time needed to stand up the seat of the seating elements is inclined forwards so that people when seated are in a partially standing position which makes easier to stand up.

In yet a further aspect of the invention the safety of the device is increased by the incorporation of securing means to avoid involuntary displacement of the passenger during transfer caused by acceleration of the transfer device.

In one embodiment the securing means comprise lateral extension of the backrest which extensions partially envelop the passenger thereby preventing lateral involuntary displacement of the passenger. Although in a preferred embodiment (which has been described above) the backrest's extensions are asymmetrical (more prominent in one side of the backrest than in the other), they do not necessarily have to be asymmetric to provide the enveloping effect that helps prevent lateral involuntary displacement of the passenger.

In another embodiment the securing means comprise hand grips located in the vicinity of the seating elements allowing the passenger to be braced in a secure position, i.e. the passenger is enabled to exert force with his arms to avoid being involuntarily displaced from the optimal seating position. The grips may preferably be mounted on the cage.

In another embodiment the securing means comprise a seat having a raised central area and two lateral areas to accommodate the legs of the passenger. This layout provides two advantages: on one side it acts as a horse saddle causing the legs to straddle the profile in such a way that lateral forces applied to the body are transferred to the buttocks and thighs into the saddle, preventing the passenger from being dislodged; on the other side this layout forces the feet of the passenger to be spread widely. By forcing a minimum separation of the feet this design feature provides a more stable position for the passenger thereby further allowing him to avoid being involuntarily displaced from the optimal seating position.

In still another embodiment the securing means comprise two footrests located in front of each seating element. The surface of the footrests prepared to receive the feet is preferably inclined in the direction of the passenger so that the angle formed by the feet and the leg is reduced enabling the passenger to exert force with his legs to avoid being involuntarily displaced from the optimal seating position.

In yet another embodiment the securing means comprise means to secure the passenger body to the seating element such as a belt or a harness, preferably a full body harness.

Preferably, the transporting device is positively buoyant where it is intended to use on water or near water.

Typically, the transporting device may have a self-righting capability in water. Preferably, the transporting device may include a keel in or below base section to enhance the self-righting performs of the transporting device.

DETAILED DESCRIPTION

Figure 1:
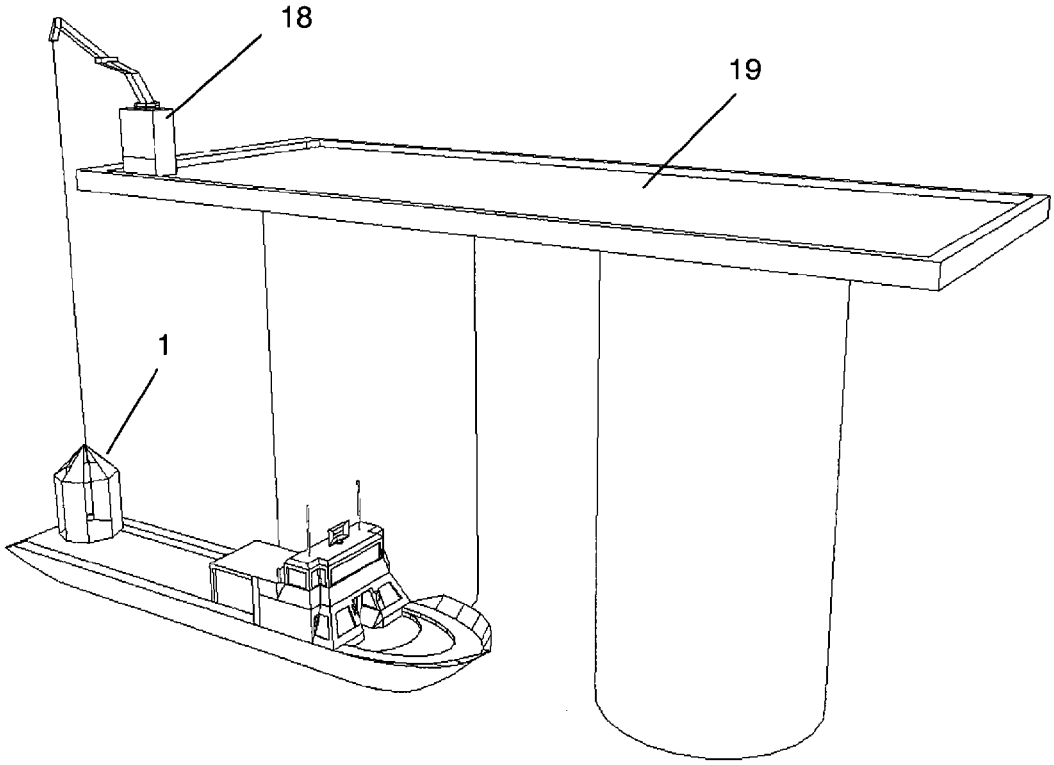
FIG. 1 is a schematic view of a transfer system comprising the transfer capsule of the present invention in use between two vessels.

A transfer system making use of the invention's the transfer device is shown in FIG. 1 and consists of a first example of a device (1) which is in the form of a cage (3) offering protection to personnel or equipment during transfer between vessels at sea. The system comprises a crane (18) mounted on a structure (such as a first vessel or a marine platform) (19), the crane can be operated to pick up and transfer the device (1) using a crane hook (not shown) which is attached to the device's coupling means (2). The transfer device (1) will usually be buoyant and self-righting to minimise the risks to personnel in the event of inadvertent immersion. The device (1) will generally be constructed of materials which are not prone to corrosion or early deterioration.

The transfer device of the present invention has means for coupling (2) it to a lifting device and comprises an outer structure in the form of a cage (3) having a base (4) in the form of a polygon which outer structure defines an inner space (5) comprising seating elements (6) where the people may sit during transfer.

The base (4) of the transfer device may be made for example of steel grating or other similar material.

In one embodiment the shape of the device approximates that of a domed polygonal prism with the means for coupling the device being located at the dome's uppermost position.

Figure 3:
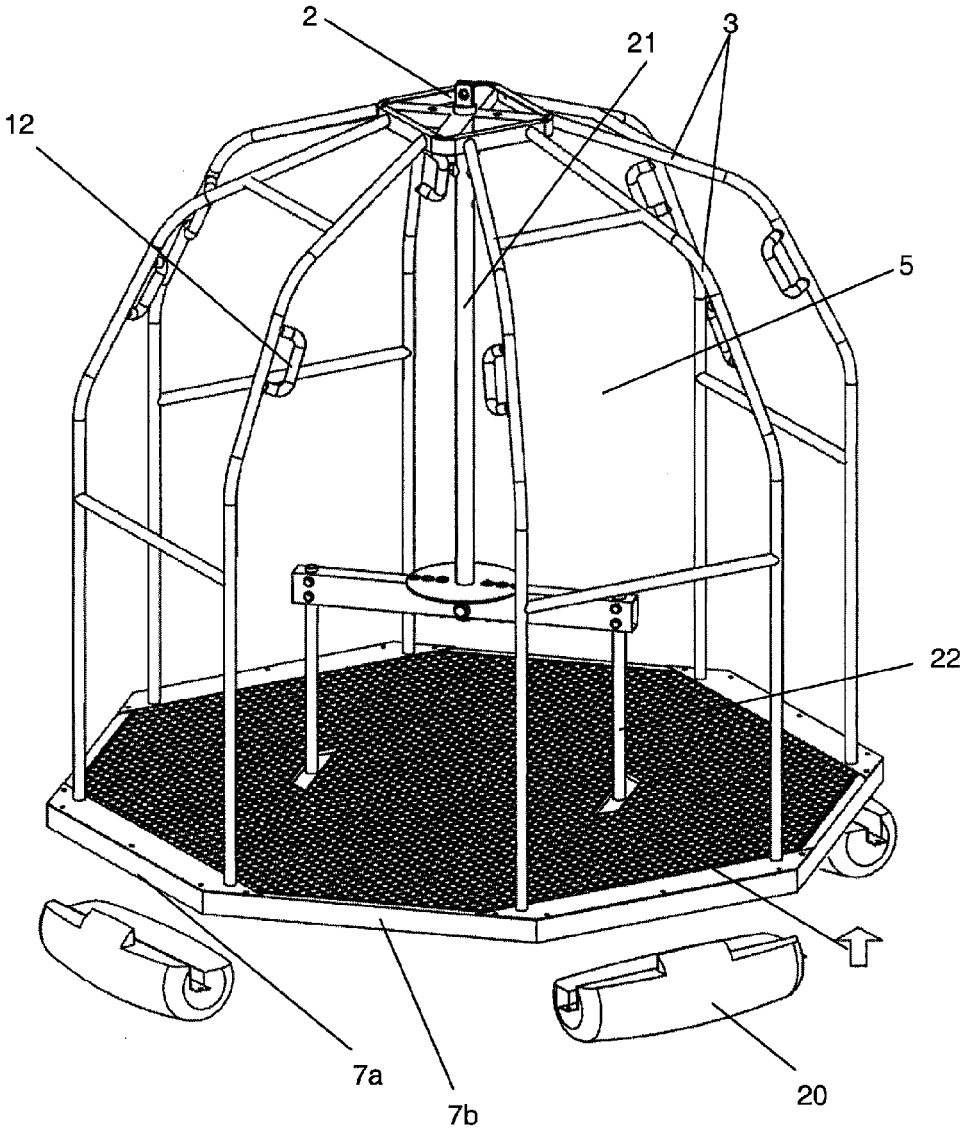
FIG. 3 is a perspective view of the transfer device of FIG. 2 where all seating elements and shock absorbing means have been removed to facilitate the view of the device's load supporting elements.

The term polygon when used in the present application to designate the shape of the transfer device's base is meant to designate not only strict polygonal figures but also figures having the general shape of a polygon where one or more of the polygon's sides are curved (for example, in the shape of an arch sharing its centre with the polygon's centre). It is also possible that the base comprises a central portion which may be in the shape of a polygon and peripheral pieces attached to the central portion as for example shock absorbing and/or flotation means (20) as is illustrated in FIG. 3.

Figure 5:
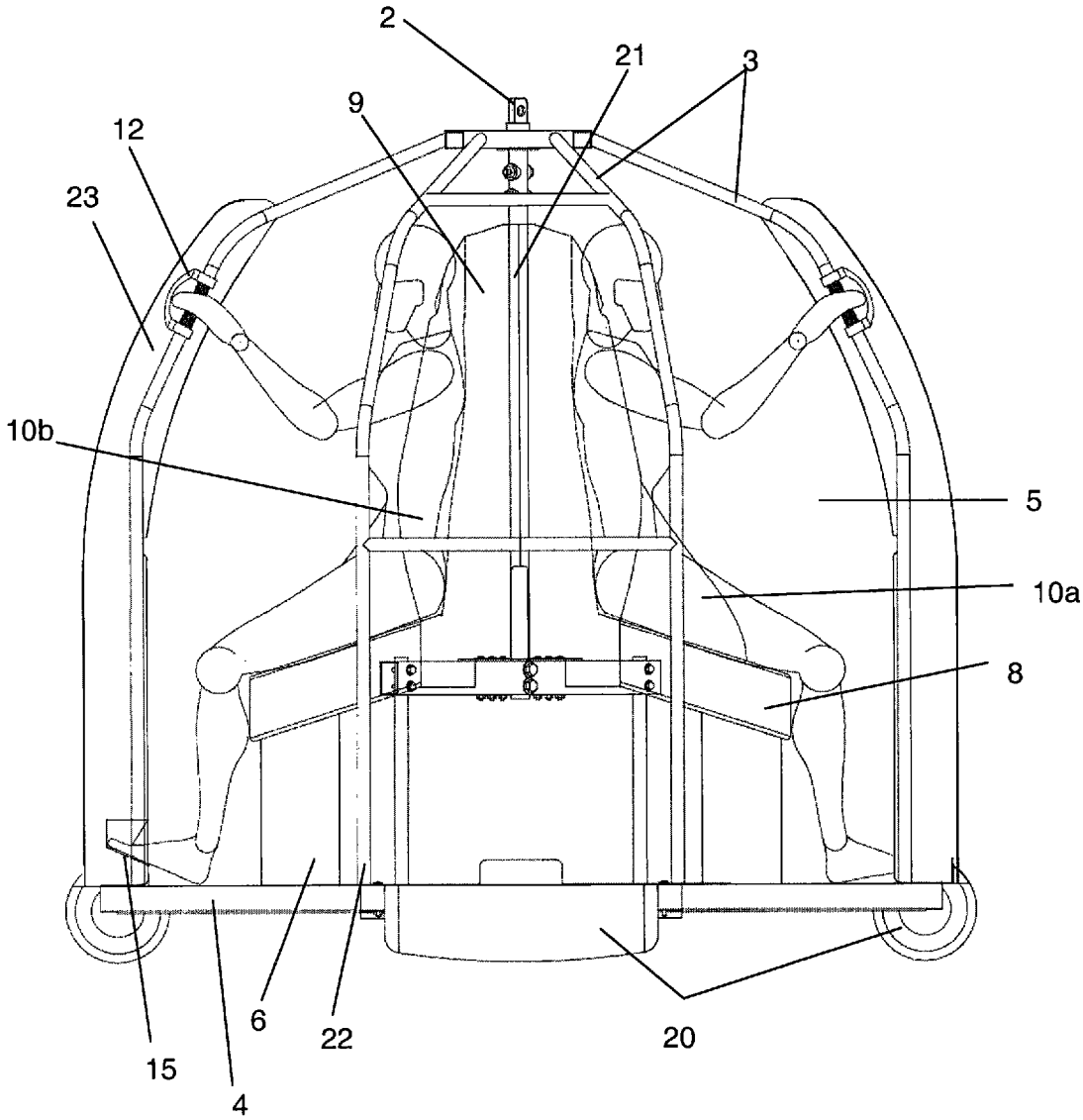
FIG. 5 is a side view of the device of FIG. 2 allowing a view of the device carrying two passengers.

The transfer device (1) is normally provided with a central vertical shaft (21) aligned with the centre of the base which is connected to the cage of the transfer device and provides a facility by which the capsule may be lifted. The central shaft (21) may at its lowermost part be divided in two or more legs (22) for example taking the shape of an inverted Y letter or an inverted Psi (LP) letter as is shown in FIGS. 3 and 5.

The central shaft (21) and the cage structure (3) are preferably made of a resistant and light material such as stainless steel tubing material. The tubes are mechanically joined (i.e. weldged or bolted) to form the cage structure.

The transfer device (1) also has seating elements (6) which are disposed on the base (4), radially around its centre and facing alternating sides (7*a*,7*b*) of the polygon. The seating elements (6) may also be attached to the shaft (21). Springing, shock absorbing and motion compensating arrangements (not shown) may also be included to provide protection from shock to passengers.

Figure 2:
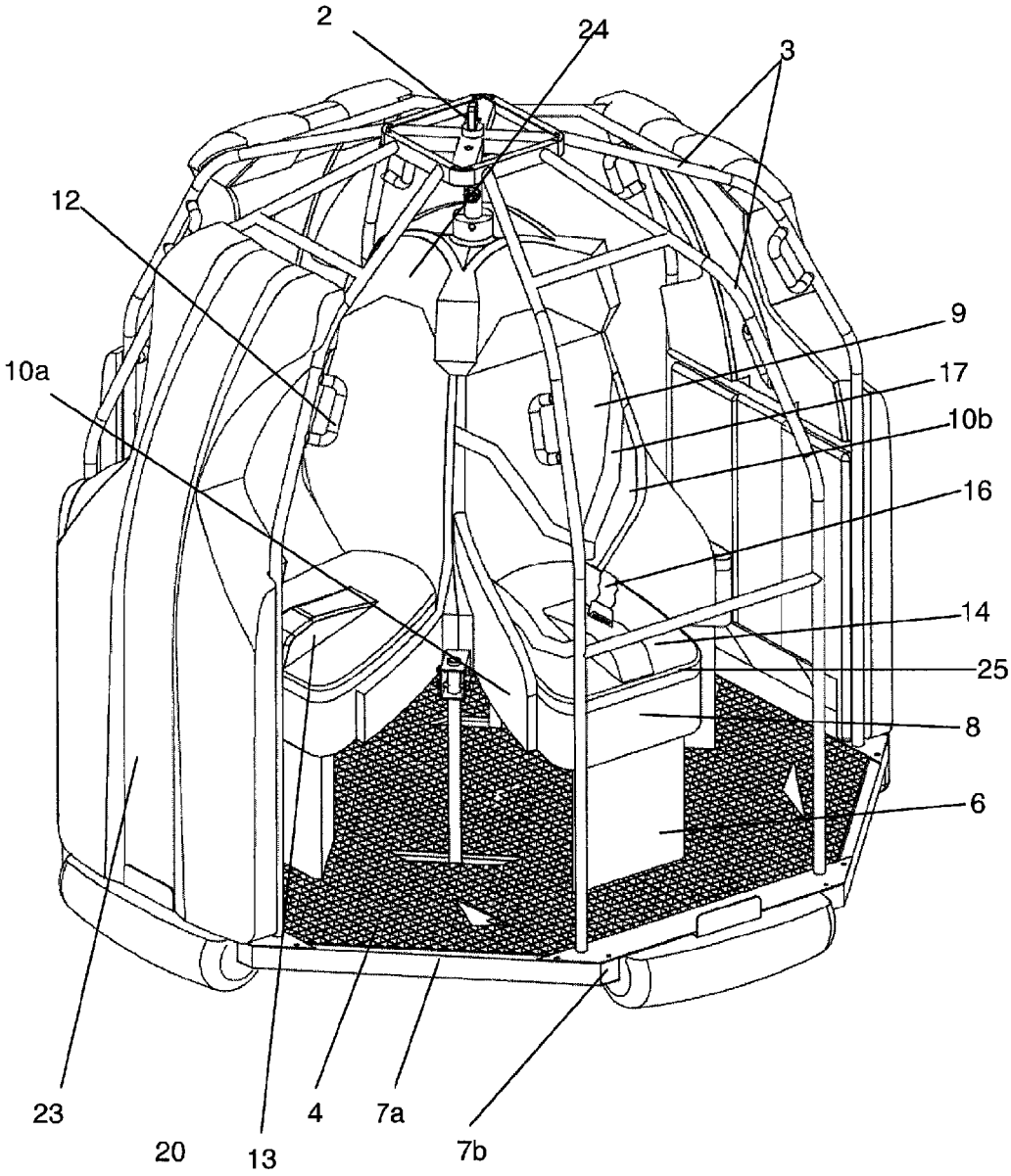
FIG. 2 is a perspective view, of an example of the transfer device shown in FIG. 1 where the shock absorbing element facing one of the seating elements has been removed to facilitate the view of the device's interior.
Figure 4:
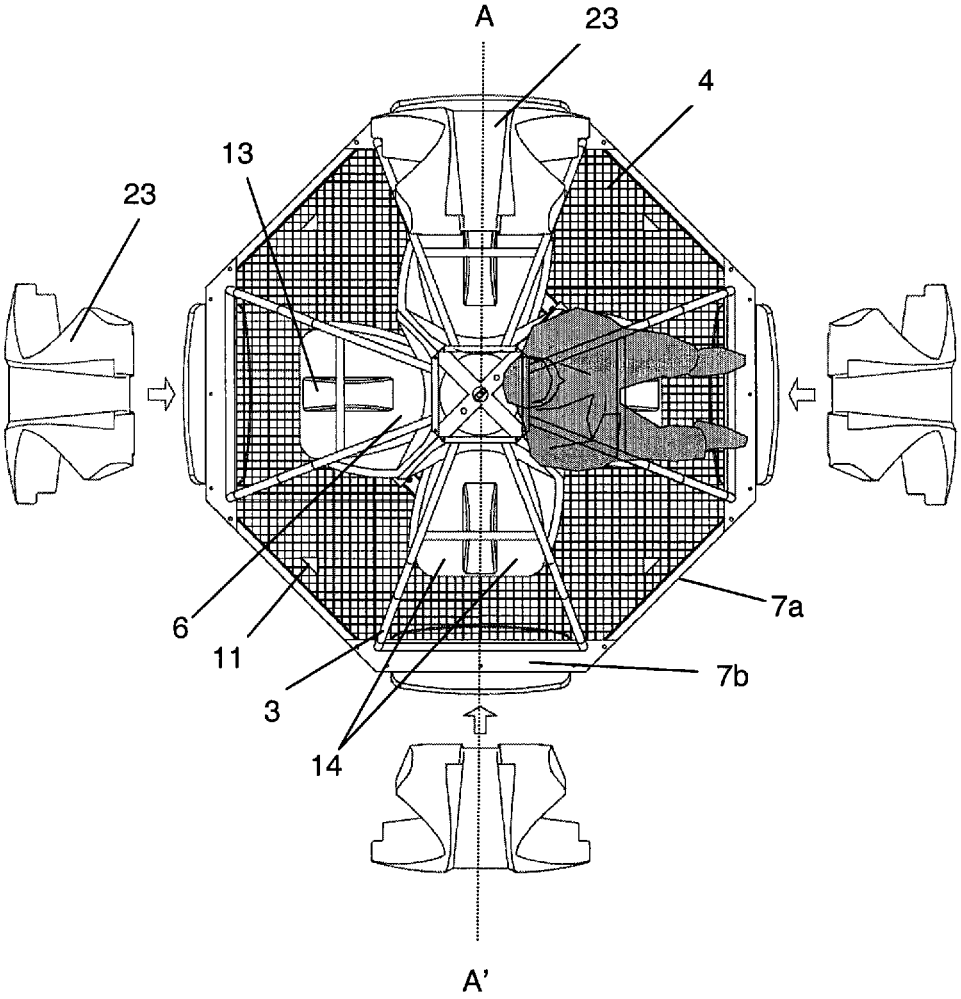
FIG. 4 is a top view of the device of FIG. 2 where the shock absorbing element facing one of three of the seating elements have been removed.

Furthermore it is a feature of the present invention that the sides of the outer structure facing each of the seating elements (6) comprise shock absorbing means (23) to protect seating people from frontal impacts. This is shown, for example in FIGS. 2, 4 and 5.

The shock absorbing elements (23) at the transfer device's sides facing the seating elements (6) may be constructed from any material capable of absorbing the forces received when the device collides with any external element during a transfer operation. An example of such shock absorbing element (23) is a foam panel attached to the cage (3) around the periphery of the device. In one embodiment the foam panel may be made in the form of a hollow moulded plastic panel filled with a foam material. In another embodiment the foam panels may be made, for example, by sandwiching a steel mesh between two sheets of foam. This shock absorbing elements may also contribute to rendering the device buoyant in water so as to keep the device afloat and to provide its self-righting characteristic. The foam panels may be fixed at the frame by tensioned wires attached to the steel mesh.

The seating elements (6) typically comprise a seat (8) and a backrest (9) and are preferably asymmetric with respect to a vertical plane (A-A') which passes through the centre of the base (4) and is perpendicular to the polygon's side which is faced by the seating element (7) thereby dividing the seat (8) and the backrest (9) in two unequal parts. In an embodiment the seat (8) and or/backrest (9) have extensions towards both sides of the seating element (6), the extension (10*a*) towards one of the sides being more prominent that the extension (10*b*) towards the opposite side. The lateral extensions (10*a*, 10*b*) serve two different purposes: firstly the envelope the body of the passenger occupying the seating element (6) thereby reducing the likelihood that the passenger is displaced from his normal seating position when the device suffers accelerations such as those taking place, for example, when the device collides with an external element; secondly the unequal size of the lateral extensions makes it easier for the passenger to take one the two possible directions when standing up from the seating element (6). In effect it will be easier for a passenger to stand up on the side which has a smaller lateral extension (10*b*).

We have already seen that lateral extensions (10*a*, 10*b*) of unequal size help facilitate a quick egress from the transfer device. Additionally further means to facilitate such egress may also be provided. For example, there may be provided on the base (4) of the device at the vicinity of each seating element, indicating means (11) showing to the passenger occupying the seating elements (6) the preferred direction of egress. In some particular embodiments the indicating means (11) may take the form of an arrow pointing towards the direction of egress or a triangle with one of its vertex pointing towards the direction of egress.

The seat (8) of the seating elements may advantageously be inclined forwards (i.e. in the direction opposed to the backrest) so that people when seated are in a partially standing position. This design feature provides two advantages: firstly the passenger being in a partially standing position will be capable of standing up more quickly to egress from the transfer device and thus the safety of the device is ameliorated; secondly when hand grips (12) are located in the vicinity of the seating elements (6), the partially standing position allows the passenger to be in a better bracing position to grasp these hand grips (12).

The seating (6) elements might be made of moulded plastic in one or more pieces. Additionally the seating elements (6) may also incorporate separate pieces such as a head rest, a cushion (25) or the like. The head rest (24) and the cushion (25) may be made of a foamed material.

Additionally the seating elements may further comprise securing means for securing the people during transfer. The term securing means is used in the present application to designate any means helping the passenger of the transfer device to avoid being displaced from his optimal seating position when the device suffers accelerations such as those taking place, for example, when the device collides with an external element.

Such additional securing means may, for example, be in the form of hand grips (12) located in the vicinity of the seating elements (6) allowing the passenger to be braced in a secure position.

Such additional securing means may, for example, also be in the form of a seat (8) having a raised central area (13) and two lateral areas (14) to accommodate the legs of the passenger forcing the feet of the passenger to be spread widely. Forcing the legs of the passenger to be spread widely places the passenger in a more stable position whereby he is less likely to be displaced from the optimal seating position when the device suffers accelerations such as those taking place, for example, when the device collides with an external element. Additional securing means helping the passenger to keep an optimal seating position may also comprise two footrests (15) located in front of each seating element (6). As it has been explained before, the surface of the footrests prepared to receive the feet is preferably inclined in the direction of the passenger so that the angle formed by the feet and the leg is reduced enabling the passenger to exert force with his legs to avoid being involuntarily displaced from the optimal seating position. In one embodiment the footrests (15) are integrally built as part of the interior of the moulded shock absorbing means (23) as can be seen in FIG. 5.

The securing means may also comprise means to attach the passenger body to the seating element such as a belt (16) or a harness (17).

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A transfer device operative to facilitate transferring people from a first location to a second location, comprising:

a base in the form of a polygon having an even number of sides;

a plurality of seating elements, each operative to support a person in a seated position during transfer, affixed to the base such that a seating element faces radially outwardly in alignment with each even-numbered side of the polygon base, when the sides are numbered consecutively around the base, and such that an ingress/egress area between each seating element is aligned with each odd-numbered side of the polygon base;

an outer structure in the form of a cage connected to at least the center and periphery of the base and extending over the seating elements;

a buoyant shock absorbing panel affixed to the outer structure at each even-numbered side of the polygon base, each panel positioned in front of each of a seating elements and operative to protect a seated person from frontal impact, and further operative to contribute to rendering the device buoyant in water; and a coupler disposed on the outer structure and operative to couple the transfer device to a lifting device.

2. The transfer device of claim 1 wherein each seating element comprises a seat that is inclined forwards such that a person seated thereon is in a partially standing position.

3. The transfer device of claim 1 wherein each seating element comprises a seat, a backrest, and a protective backrest extension extending to one side of the seat and operative to contain a seated person, wherein the side of the seat opposite the protective backrest extension is clear to facilitate ingress and egress.

4. The transfer device of claim 3 wherein each seating element further comprises a partial backrest extension extending to the side of the seat opposite the protective backrest extension, the partial backrest extension operative to partially contain a seated person while leaving a clear area to facilitate ingress and egress.

5. The transfer device of claim 3 wherein the protective backrest extension extends to the same side of each seat in the device.

6. The transfer device of claim 1 wherein the seat of each seating element comprises a raised central area and two lateral areas to accommodate the legs of a passenger and force the feet of the passenger to be spread widely, so as to more securely hold the passenger in the seating element.

7. The transfer device of claim 1 wherein each seating element further comprises one of a belt or harness operative to secure a passenger into the seating element.

8. The transfer device of claim 1 further comprising two footrests disposed in front of each seating element.

9. The transfer device of claim 1 further comprising hand grips located proximate to each seating element and operative to brace passengers in the seating element in a secure position when gripped.

10. The transfer device of claim 1 further comprising a plurality of flotation devices affixed to the base.

11. The transfer device of claim 1 wherein the outer structure, each odd-numbered side of the polygon base, is free from structural members or shock absorbing panels, so as to define a clear passageway positioned between each seating element, for ingress to and egress from the transfer device.

12. The transfer device of claim 1 wherein the polygon base comprises eight sides, and wherein the transfer device includes four seating elements.

* * * * *